US005942717A

United States Patent [19]

Pathe et al.

[11] Patent Number: 5,942,717

[45] Date of Patent: Aug. 24, 1999

[54] ELECTRO-PYROTECHNIC INITIATOR, METHOD FOR MAKING SAME, AND VEHICLE SAFETY SYSTEM

[75] Inventors: Claude Pathe, Hery; Raphaël Trousselle, Auxerre, both of France

[73] Assignee: Davey Bickford, Rouen Cedex, France

[21] Appl. No.: 08/930,515

[22] PCT Filed: Apr. 1, 1996

[86] PCT No.: PCT/FR96/00490

§ 371 Date: Jan. 2, 1998

§ 102(e) Date: Jan. 2, 1998

[87] PCT Pub. No.: WO96/30714

PCT Pub. Date: Oct. 3, 1996

[30] Foreign Application Priority Data

Mar. 31, 1995 [FR] France ..... 9503855

[51] Int. Cl.[6] ..... F42B 3/18; F42C 19/12

[52] U.S. Cl. ..... 102/202.2; 102/202.5; 102/202.7; 102/202.14

[58] Field of Search ..... 101/202.1, 202.2, 101/202.5, 202.7, 202.14

[56] References Cited

U.S. PATENT DOCUMENTS

| | | | |
|---|---|---|---|
| 3,334,205 | 8/1967 | Griffin . | |
| 3,971,320 | 7/1976 | Lee . | |
| 4,220,088 | 9/1980 | Kimura et al. | 102/202.14 |
| 4,369,708 | 1/1983 | Bryan et al. | 102/202.14 |
| 5,230,287 | 7/1993 | Arrell, Jr. et al. . | |
| 5,345,872 | 9/1994 | Takahashi et al. | 102/202.2 |
| 5,433,147 | 7/1995 | Brede et al. | 102/202.5 |
| 5,452,661 | 9/1995 | Neff | 102/202.7 |
| 5,596,163 | 1/1997 | Caflisch et al. | 102/202.2 |
| 5,648,634 | 7/1997 | Avory et al. | 102/202.1 |

FOREIGN PATENT DOCUMENTS

| | | |
|---|---|---|
| 0 445 002 | 9/1991 | European Pat. Off. . |
| 0 600 791 | 6/1994 | European Pat. Off. . |
| 0 658 739 | 6/1995 | European Pat. Off. . |
| 1114035 | 4/1956 | France . |
| 862987 | 3/1961 | United Kingdom . |

*Primary Examiner*—Harold J. Tudor
*Attorney, Agent, or Firm*—Young & Thompson

[57] ABSTRACT

An electro-pyrotechnic initiator includes two electrical pins (7) for supplying current, a pyrotechnic composition (4) stored in a receptacle (2, 3) and a bridge (23) establishing an electrical connection between the two pins (7). The bridge (23) is set down on a wafer (11), the bridge (23) and the wafer (11) forming part of an electronic micro-component (20) to which the pins (7) are connected. The composition (4) is compacted in the receptacle (2, 3), the composition (4) and the micro-component (20) being brought together under pressure in the receptacle (2, 3). A housing for a helium saturated material is provided at a bottom of the receptacle.

8 Claims, 1 Drawing Sheet

ELECTRO-PYROTECHNIC INITIATOR, METHOD FOR MAKING SAME, AND VEHICLE SAFETY SYSTEM

This invention relates to an electro-pyrotechnic initiator.

The purpose of this type of device is to be ignited by the passage of an electric current greater than a predetermined threshold value, so as to put a mechanism into action.

The electro-pyrotechnic initiators are intended to be integrated into electro-technical chains. In particular, they are used in safety systems for a car or for other vehicles, for example, in order to activate a safety air-bag. They are also used, for example, in missiles.

Such an electro-pyrotechnic initiator is known, for example, from document U.S. Pat. No. 5,230,287. This known electro-pyrotechnic initiator comprises two electrical pins for supplying current, inserted into a baseplate, a bridge establishing an electrical connection between the two pins, a pyrotechnic composition stored in a receptacle, an electronic circuit comprising a bridge laid down on a wafer, this wafer being connected to the electrical pins for supplying current, and the pyrotechnic composition being compacted in the receptacle and brought together with the micro-component under pressure in the receptacle.

The invention also relates to a method of producing an electro-pyrotechnic initiator, and a safety system for a vehicle comprising one or several initiators.

The initiators used until now have usually consisted of a device comprising two electrical pins, connected by a soldered filament that forms a conducting bridge arranged in contact with a pyrotechnic composition.

The rudimentary aspect of the connection between the pins has the major disadvantage of not providing sufficient control over the ignition.

In more highly developed initiators, the conducting bridge is made on a printed circuit or an equivalent support. Greater precision is then possible.

However major disadvantages remain. In particular, a bead of solder is necessary at the electrical connection between the conducting bridge and the pins for supplying current. This impairs the flatness of the interface of the conducting bridge with the pyrotechnic composition and affects the evenness of the heat exchange. The bead of solder also necessitates to use deposition technology, involving the deposition of drops or of pyrotechnic product paint, technology which is not highly regarded for large scale serial manufacture.

Furthermore, these devices have an architecture which does not equally well provide for receiving a conducting or a semi-conducting bridge.

Another disadvantage of the initiators usually used is that protection against discharges of static electricity is not taken into account. Very serious consequences can result to the user from this.

Regarding the detection of leaks, usually it is done by the injection of helium and then detection through aspiration. This method is time consuming to implement and is not very reliable.

The invention is directed towards remedying these disadvantages.

The aim of the invention is thus an electro-pyrotechnic initiator that permits precise control of an ignition, that is capable of being integrated into a high performance chain calling for a high level of reliability.

Another object of the invention is an initiator capable of equally well receiving a conducting or a semi-conducting bridge, with identical architectures, the semi-conducting bridge providing a more rapid heat exchange with the pyrotechnic composition.

It is also an aim of the invention to provide an initiator that is stable over time.

A further object of the invention is to provide protection against discharges of static electricity.

A supplementary aim of the invention is a technology that makes use of a compacted form of the pyrotechnic composition, that allows the integrity of the interface between the bridge and the composition to be preserved even after long storage.

Another object of the invention is an initiator having a long life due to its gas tight properties.

The invention also has as an object, a very simple method of producing an electro-pyrotechnic initiator having the advantages above.

The invention relates also to a safety system for a vehicle that comprises such an initiator.

To this effect, the invention relates to an electro-pyrotechnic initiator comprising;

- two electrical pins for supplying current inserted into a baseplate,
- a bridge setting up an electrical connection between the two pins,
- a pyrotechnic composition stored in a receptacle.

According to the invention, this bridge is set down on a wafer, the bridge and the wafer forming part of an electronic micro-component, the wafer is connected to the pins and the composition is compacted in the receptacle. The composition and the micro-component are brought together under pressure in the receptacle.

In comparison with existing initiators, the pyrotechnic initiator according to the invention thus provides a unique architecture that allows the integration of a conducting or a semi-conducting bridge equally well. What is more, the initiator can be produced from two sub-assemblies, respectively an electrical and a pyrotechnic sub-assembly, assembled under pressure in such a way that the integrity of the interface between the micro-component and the composition is preserved. The compaction of the pyrotechnic composition permits, in addition, perfect control of the ignition thanks to the bridge of the electronic component.

According to one preferred embodiment of the initiator, the receptacle has gas tight walls, the baseplate is a gas tight crossover and the connection between the walls and the baseplate is also gas tight. Hence infiltration into the composition is avoided.

The initiator advantageously comprises a housing inside the receptacle, this housing comprising a material saturated with helium, allowing the detection of possible leaks.

Instead of the laborious method usually used to detect a possible leak, the initiator according to the invention permits very simple testing of gas tightness. The material saturated with helium, in effect constitutes a sponge and any leakage of the case causes a loss of helium that can be easily detected by aspiration.

In the preferred embodiment, with gas tight walls, it is judicious for the receptacle to comprise an electrically insulating cup and a metal case with gas tight walls containing this cup.

Preferably the receptacle has one area of these walls that has been thinned or weakened in such a way that ignition of the pyrotechnic composition has a favoured effect into this area.

Advantageously, the initiator comprises an insulating cap which, with the cup, constitutes an electrically insulating cage protecting the pyrotechnic composition from any attack resulting, in particular, from discharges of static electricity.

In a first configuration of the initiator, the bridge, being a conductor, is constituted by a resistive layer of constant thickness.

The resistive layer advantageously has a rectangular surface, for example, a square surface.

An accurate determination of the resistance of the component and of a size of current capable of triggering the initiator is hence obtained.

In a second configuration of the initiator according to the invention, the bridge is a semi-conductor.

In addition, two contact pads are advantageously provided at opposite ends of the wafer, these pads being intended to facilitate the brazing of the pins.

This device eliminates any problem posed by beads of solder.

The invention also relates to a method of producing an electro-pyrotechnic initiator. According to the invention:

- in a first step, a pyrotechnic composition is compacted in a receptacle, in such a way as to form a pyrotechnic sub-assembly,
- in a second step, a bridge is set down on a wafer and this wafer is brazed onto electrical pins embedded in a baseplate in such a way as to form an inert sub-assembly,
- in a third step, the pyrotechnic and the inert sub-assemblies are joined together under pressure.

This separate assembly of the two sub-assemblies provides at the same time simplicity of implementation and great precision in the triggering characteristics.

The invention also relates to a safety system for a vehicle including at least one electro-pyrotechnic initiator according to the invention, liable of activating a safety mechanism.

The invention will be described in greater detail, making reference to the drawings, in which.

Figure 3:
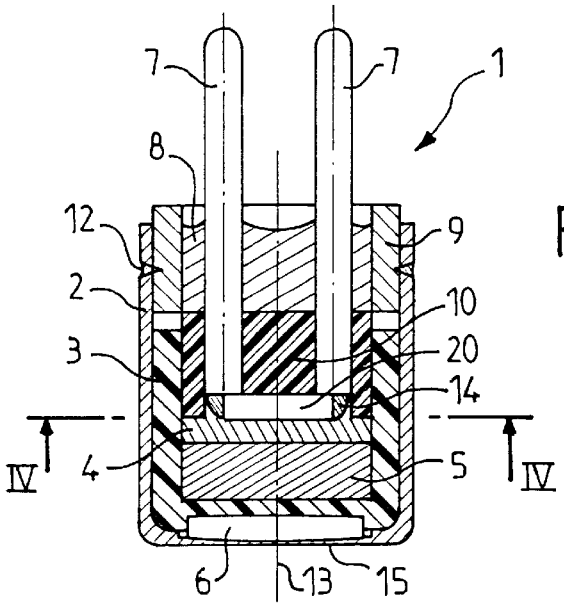
FIG. 3 shows an assembly of the sub-assemblies respectively the inert and the pyrotechnic sub-assemblies of FIGS. 1 and 2, constituting the initiator described by way of example.

The electro-pyrotechnic initiator 1, representative of the invention, and shown in FIG. 3, comprises two parts: a first inert sub-assembly 18 comprising, electrical elements and a second pyrotechnic sub-assembly 19, containing products used for ignition.

Figure 1:
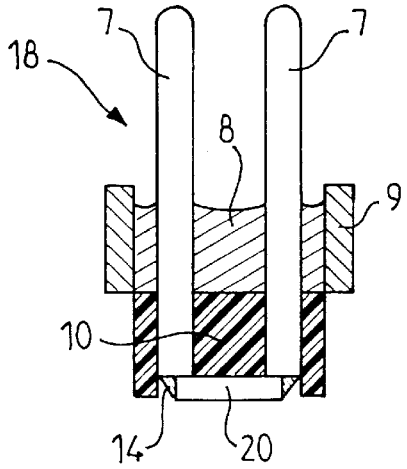
FIG. 1 represents a longitudinal section of an inert sub-assembly, comprising electrical elements, forming part of an initiator according to the invention.

The inert sub-assembly 18, represented in FIG. 1, comprises two electrical pins 7 intended to be connected to an electrical circuit. These two metal pins 7 for supplying current are typically made of FN50 iron nickel alloy. Their diameter is, for example 1 mm. The pins are hermetically sealed into an electrically insulating baseplate. This is preferably made of glass, but can equally well be made of ceramic or plastic, for example. A cylindrical body 9 surrounds this baseplate 8 to which it is hermetically joined. This metal body 9 is preferably made in stainless steel. The baseplate 8 is covered with a cap slipped onto the pins 7. This cap 10 is made of an electrically insulating material, and is preferably made of plastic. Typically it is made in a polyamide. The cap 10 electrically insulates the metal body 9 from the pyrotechnic part.

An electronic micro-component 20 is brazed onto the pins 7. The cap 10 makes its positioning easier and contributes to the insulation of the pyrotechnic part.

Figure 2:
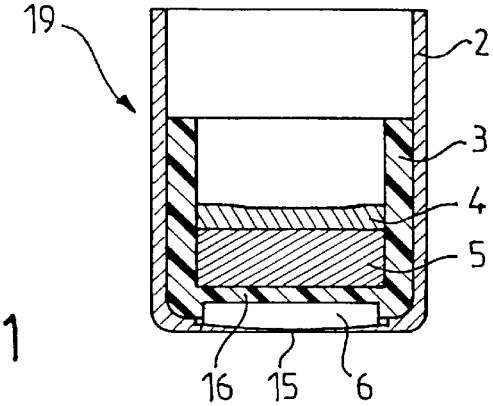
FIG. 2 represents a longitudinal section of a pyrotechnic sub-assembly corresponding to the inert sub-assembly in FIG. 1.

The pyrotechnic sub-assembly 19, that can be seen in FIG. 2, comprises the initiation pyrotechnic composition 4. This is a substance sensitive to heat. Typically it can be chosen from among lead azide, tetrazene, the lead mononitro-resorcinates, the lead dinitro-resorcinates and the lead trinitro-resorcinates. The latter substance is the one chosen in the example.

The pyrotechnic composition 4 is accompanied by a composition 5 that reinforces the pyrotechnic effect. This reinforcing composition 5 is of the oxidoreduction type. Its reducing agent is typically based on zirconium, boron, titanium, or titanium or boron hydride. In a preferred embodiment. It contains 50 to 70% potassium perchlorate, 0 to 10% of boron, 20 to 40% titanium hydride and 2 to 5% fluorinated binding agent.

The compositions 4 and 5 are compacted under pressure in an insulating cup 3. This is preferably made of plastic material. The composition 5 for reinforcing the pyrotechnic effect is compacted towards the bottom 16 of the cup 3, and the pyrotechnic composition 4 is compacted above it. For example, 50 mg of composition 5 and then 30 mg of pyrotechnic composition 4 are compacted successively.

The cup 3 containing the pyrotechnic composition 4 and the composition 5 for reinforcing the pyrotechnic effect is itself contained in a case 2, preferably made of metal.

The cup 3 and the cap 10, when assembled constitute an electrically insulating cage which protects the pyrotechnic composition from any attack, resulting, in particular from discharges of static electricity.

The case 2 has a bottom 15 which has been thinned in such a way as to create a preliminary weakening of it. An ignition of the pyrotechnic composition 4 thus has a favored effect in the direction of the bottom 15. The bottom 16 of the cup 3 also has a reduced thickness.

Between the bottom 16 of the cup 3 and the bottom 15 of the case 2, a housing 6 is provided. This housing 6 is filled with a material saturated with helium, preferably being in the form of a thin disc. This is set down in the bottom 15 of the case 2 before putting in the cup 3. This device allows the hermetic sealing of the initiator 1 to be tested easily with the help of a helium detector.

The inert sub-assembly 18 and the pyrotechnic sub-assembly 19 are assembled in compression around a common axis 13, as shown in FIG. 3 to form the initiator 1. The case 2 and the body 9 are made integral by a laser ring weld 12. This weld permits the maintenance of constant compression and guarantees the hermetic seal. By way of example, it can guarantee a compressive condition of 500 bars to a pyrotechnic charge. The assembly of the two sub-assemblies 18, 19 can also be carried out by sticking the case 2 and the body 9 together.

The assembly under pressure of the two sub-assemblies 18, 19 prevents the presence of air between the micro-component 20 and the pyrotechnic composition 4 which would impair control of the heat exchange. The general advantage of this assembly is that it allows the integrity of the interface between the bridge 23 and the composition 4 to be preserved, this being created precisely in accordance with the desired configuration.

In the assembly thus developed, the cap 10 electrically insulates the pyrotechnic composition 4 from the metal body 9. The glass baseplate 8 provides for itself the hermetic sealing of the passage between the pins 7 and the metal body 9 and also allows the compressive condition to be maintained.

The weld 12 prevents infiltration between the case 2 on the one hand and the body 9 and the cup 3 on the other hand, thereby providing an excellent hermetic seal for the contents of compositions 4 and 5. It also permits maintenance of the compressive condition.

Figure 4:
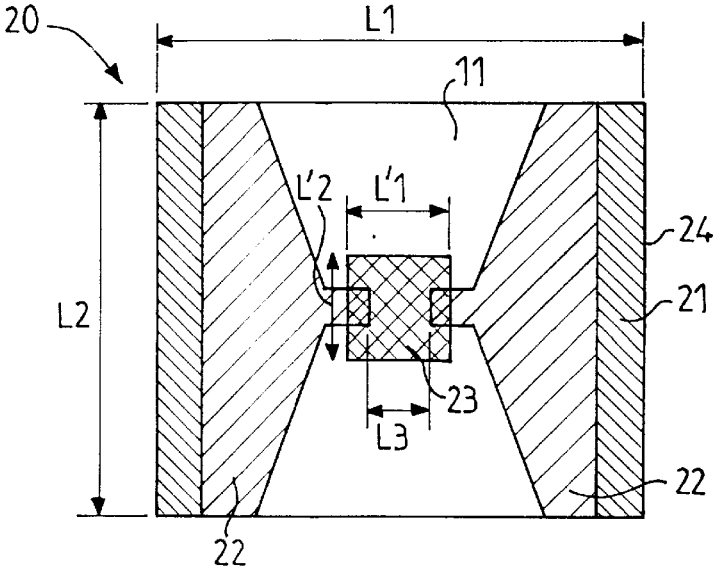
FIG. 4 represents an electronic micro-component used in the initiator of FIG. 3, along a cross section IV—IV.

The electronic micro-component 20, detailed in FIG. 4, comprises a wafer 11, preferably made of alumina. By way of example, it has a length L1 of 3 mm in the direction moving from one pin 7 to the other, a width L2 equal to 2.54 mm and a thickness of 0.635 mm. On this wafer 11, using a photo-lithography method, two conductive tracks 22 are laid down on or symmetrically arranged at the side of each of the pins 7. The tracks 22 are separated by a gap L3 of about 100 $\mu$m.

A bridge 23 is serigraphed onto this gap L3. It can also be photolithographed or deposited under vacuum. In the example presented, it is a resistance, this typically being created by serigraphy with the help of ruthenium based ink.

Figure 5:
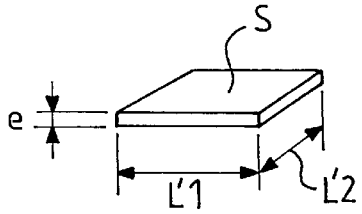
FIG. 5 represents a perspective view of the bridge in FIG. 4.

The bridge 23, visible in FIGS. 4 and 5, has a length L'1 in accordance with the length L1 of the wafer 11, a width L'2 in accordance with the width L2 of the wafer 11 and a thickness e. Hence it has a surface area S equal to L'1×L'2. Also its cross section is defined as e×L'2. By calling p the resistivity of the bridge 23, the resistance R of the bridge is given by:

$$R = \frac{\rho}{L'2} \times \frac{L'1}{e} = \rho \times \frac{L'1}{L'2} \times \frac{1}{e}$$

If one keeps a constant ratio of L'1/L'2 for the rectangular surface S of the resistive bridge 23, the resistance R is simply modified by varying the thickness e and the resistivity ρ. In particular, it is possible to choose a square surface S, in which case L'1 is equal to L'2. In this case, the resistance R has the value ρ/ e.

The choice of lengths L'1 and L'2 permits adjustment of two important values: a non-operational current I0 and an operational current I1. The current I0 defines a current threshold passing through the bridge 23 short of which the heating of the wafer 11 is not sufficient to trigger ignition of the initiator 1. The operational current I1, greater than the non-operational current I0, defines a threshold beyond which the initiator 1 is systematically ignited. Between I0 and I1, triggering of the initiation is not guaranteed.

The currents I0 and I1 can be easily adjusted by taking action on the surface area S: the smaller it is, the lower the values of I0 and I1. The composition of the bridge 23 also plays a pail in their determination.

By carefully choosing the dimensional, mechanical and thermal characteristics of the resistive bridge 23, it is therefore possible to adjust precisely the resistance R and the currents I0 and I1.

In the example chosen, the bridge 23 has a square surfaces, and the lengths L'1 and L'2 are both equal to 150 $\mu$m. For an automobile, the resistance R typically has a value of the order of 2Ω±0.15Ω.

The contact pads 21 made of platinum-gold are also deposited at opposite ends of the wafer 11 corresponding to the positioning of the pills 7. The pads 21 cover these ends over the whole width L2 of the wafer 11. These deposits are made on both faces of the wafer 11 as well as on the edges 24 corresponding to the ends involved. The pads 21 facilitate the brazing of the pills 7, in the same way as for electronic components mounted in surface onto printed circuits. The pins 7 are of the kind connected to the wafer 11 in accordance with a widely proven soldering method.

The assembly comprising the wafer 11, the resistive bridge 23, the conductive tracks 22, and the contact pads 2 1 constitutes the electronic micro-component 20.

In the case of a semi-conducting bridge 23 the architecture adopted is exactly the same. Typically, the wafer 11 is then made of a semi-conductor material deposited onto a support made of a ceramic material.

The use of a semi-conducting bridge 23 is particularly advantageous, since it allows great precision in the triggering of the initiator 1. In effect, it only becomes resistive at a fixed level of voltage. When this level is reached, it causes a cascade phenomenon, beginning with a heating up of the bridge 23, going hand in hand with a reduction in its resistance and ending with the discharge of a plasma in the composition 4. A minimum duration of application of the current is required to cause an ignition.

While the thermal exchanges for a resistive component 20 are brought about through conduction, they occur essentially through convection in the semi-conductor case. Although the importance of a perfectly controlled interface between the composition 4 and the component 20 is recognised to be not as great, it remains desirable.

During the assembly, the inert 18 and pyrotechnic 19 sub-assemblies are assembled under pressure, a pressure, for example, of 500 bars being exerted on the pyrotechnic composition 4. They are subsequently joined by the weld 12, which maintains the pressure applied beforehand after release.

The architecture is independent of the way in which the sub-assemblies 18 and 19 are produced. This simplifies the manufacture of the two types of initiator on the same site from sub-assemblies 18, 19. This general configuration makes it possible to obtain great precision in the ignition.

The gas tightness of the operational initiator 1 is subsequently verified before its installation in a vehicle with a helium detector, in order to detect any possible leaks coming from the material saturated with helium stored in the housing 6.

In operation, in the presence of a conducting bridge 23, a small current passes through the pins 7 connected to an electrical circuit in the component 20. This current, which can be zero, is insufficient to trigger the initiator 1. It is less than the non-operational current 10 for the conducting bridge 23. Ignition of the initiator 1 is caused by an appreciable increase in the current passing through the pins 7 and greater than the operational current I1. Very rapid heating of the conducting bridge 23 then ensues, which is transmitted to the pyrotechnic composition 4 through the wafer I1. An explosion is then triggered, its effects being propagated in a favoured way in the direction of the bottom 16 of the cup 3.

If the bridge 23 is a semi-conductor, the operation is entirely similar. Ignition of the initiator 1 is however caused in a more abrupt fashion as soon as a current passing through the pins 7 has a value exceeding a threshold value associated with the semi-conducting bridge 23 and its duration is sufficient.

Although the bridges 23 presented by way of example are particularly advantageous, other configurations can also be envisaged. In particular, the bridge 23 can be constituted by a thin layer as well as by a thick layer. It can also have a surface S that is other than rectangular and is, for example of a circular or polyhedral shape.

Furthermore, if the gas tightness is not as good as in the example described and there would be creep modifying the interface between the component 20 and the pyrotechnic composition 4, it could be contemplated to produce the case 2 and the body 9 in a plastic material. The presence of the insulating cup 3 would then no longer be necessary.

The initiator according to the invention is usable, in particular, in vehicles to put safety mechanisms, such as air bags, devices for locking and unlocking doors or pretensioning devices for safety belts, into action rapidly. However, it is also suitable for any other device that requires rapid triggering and good control over a mechanism. By way of example, it is usable in offensive or defensive military systems and in systems for protection fires or floods.

We claim:

1. An electro-pyrotechnic initiator (1) comprising:

two electrical pins (7) for supplying current inserted into a baseplate (8), a bridge (23) setting up an electrical connection between the two pins (7), a pyrotechnic composition (4) stored in a receptacle (2, 3) comprising an electrically insulating cup (3) and a metal case (2) with gas tight walls containing said cup (3), said pins extending from a top of said case, said bridge (23) being laid down on a wafer (11), the bridge (23) and the wafer (11) forming part of an electronic micro-component (20) and the wafer (11) being connected to the pins (7) and the composition (4) being compacted in the receptacle (2, 3), the composition (4) and the micro-component (20) being brought together under pressure in the receptacle (2, 3), and a housing (6) inside the receptacle (2, 3) between a bottom (16) of said cup (3) and a bottom of said case (2), said housing (6) comprising a material saturated with helium, allowing the detection of possible leaks, by aspiration.

2. An electro-pyrotechnic initiator (1) according to claim 1, wherein, the baseplate 8 is a gas tight crossover and the connection between the baseplate 8 and the walls of the receptacle (2, 3) is also gas tight.

3. An electro-pyrotechnic initiator according to claim 2, further comprising an insulating cap (10) which, with the cup (3), constitutes an electrically insulating cage protecting the pyrotechnic composition from discharges of static electricity.

4. An electro-pyrotechnic initiator (1) according to claim 1, wherein the receptacle (2, 3) has an area (15, 16) at the bottom of said case (2) which forms a wall of said housing (6) that is weakened so that igniting the pyrotechnic composition (4) has a favored effect into said area (15, 16).

5. An electro-pyrotechnic initiator (1) according to claim 1, wherein the bridge (23) comprises a resistive layer (23) of constant thickness (e).

6. An electro-pyrotechnic initiator (1) according to claim 5, wherein the resistive layer has a rectangular surface (S).

7. An electro-pyrotechnic initiator (1) according to claim 1, wherein the bridge (23) is a semi-conductor.

8. An electro-pyrotechnic initiator (1) according to claim 1, further comprising two contact pads (21) at opposite ends of the wafer (11), said pads (21) for facilitating brazing of the pins (7).

* * * * *